US011268359B2

(12) United States Patent
Bahr et al.

(10) Patent No.: US 11,268,359 B2
(45) Date of Patent: Mar. 8, 2022

(54) WELL STIMULATION OPERATIONS

(71) Applicant: CONOCOPHILLIPS COMPANY, Houston, TX (US)

(72) Inventors: Lars Christian Tronstad Bahr, Tananger (NO); John P. Spence, Tananger (NO); Svein Kristian Furre, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/100,316

(22) Filed: Nov. 20, 2020

(65) Prior Publication Data

US 2021/0156236 A1 May 27, 2021

Related U.S. Application Data

(60) Provisional application No. 62/988,212, filed on Mar. 11, 2020, provisional application No. 62/939,271, filed on Nov. 22, 2019.

(51) Int. Cl.

| | |
|---|---|
| ***E21B 34/04*** | (2006.01) |
| ***E21B 34/06*** | (2006.01) |
| ***E21B 43/013*** | (2006.01) |
| ***E21B 43/12*** | (2006.01) |
| ***E21B 43/27*** | (2006.01) |
| ***E21B 47/06*** | (2012.01) |

(Continued)

(52) U.S. Cl.

CPC ..... *E21B 43/12* (2013.01); *E21B 34/04* (2013.01); *E21B 34/06* (2013.01); *E21B 43/013* (2013.01); *E21B 43/27* (2020.05); *E21B 47/06* (2013.01); *E21B 47/07* (2020.05); *E21B 47/13* (2020.05)

(58) Field of Classification Search

CPC ..... E21B 34/04; E21B 34/06; E21B 43/013; E21B 43/12; E21B 43/27; E21B 47/06; E21B 47/07; E21B 47/13

See application file for complete search history.

(56) References Cited

U.S. PATENT DOCUMENTS 4,339,002 A * 7/1982 Gibbs ..... B63B 22/021 166/355
5,226,482 A * 7/1993 Giannesini ..... E21B 43/017 166/353

(Continued)

FOREIGN PATENT DOCUMENTS

EP 2715046 B1 5/2017

OTHER PUBLICATIONS

International Search Report and Written Opinion dated Feb. 10, 2021; 10 pgs.

*Primary Examiner* — Matthew R Buck
(74) *Attorney, Agent, or Firm* — ConocoPhillips Company

(57) ABSTRACT

The invention relates to the fluid treatment, such as acid stimulation, of a subsea hydrocarbon well via a subsea wellhead/Christmas tree. Fluid is delivered directly to the subsea wellhead from a pumping vessel. Control of the delivery of fluid is from the pumping vessel via a fail-safe close valve in the delivery line. The Christmas tree subsea module is controlled directly from a host platform via a subsea cable, whilst a radio data link between the vessel and host platform provides communication of downhole data to the pumping vessel during the operation.

10 Claims, 1 Drawing Sheet

(51) Int. Cl.
*E21B 47/07* (2012.01)
*E21B 47/13* (2012.01)

(56) References Cited

U.S. PATENT DOCUMENTS

| | | | | |
|---|---|---|---|---|
| 6,536,528 | B1 * | 3/2003 | Amin | B63B 22/021 166/369 |
| 7,234,524 | B2 * | 6/2007 | Shaw | E21B 41/02 166/304 |
| 7,958,938 | B2 | 6/2011 | Crossley et al. | |
| 8,857,520 | B2 | 10/2014 | Hoffman et al. | |
| 9,574,420 | B2 * | 2/2017 | Hall | E21B 17/20 |
| 9,695,665 | B2 * | 7/2017 | Older | E21B 33/076 |
| 9,720,421 | B2 * | 8/2017 | Kleine | G05D 7/0617 |
| 2006/0064256 | A1 * | 3/2006 | Appleford | E21B 43/12 702/31 |
| 2010/0276155 | A1 | 11/2010 | Niemeyer et al. | |
| 2010/0300696 | A1 | 12/2010 | Mccalvin et al. | |
| 2011/0067881 | A1 | 3/2011 | Blake | |
| 2013/0088360 | A1 | 4/2013 | Mcstay et al. | |
| 2018/0171759 | A1 * | 6/2018 | Meyer | E21B 34/04 |
| 2020/0392823 | A1 * | 12/2020 | Rodrigues | E21B 43/013 |

* cited by examiner

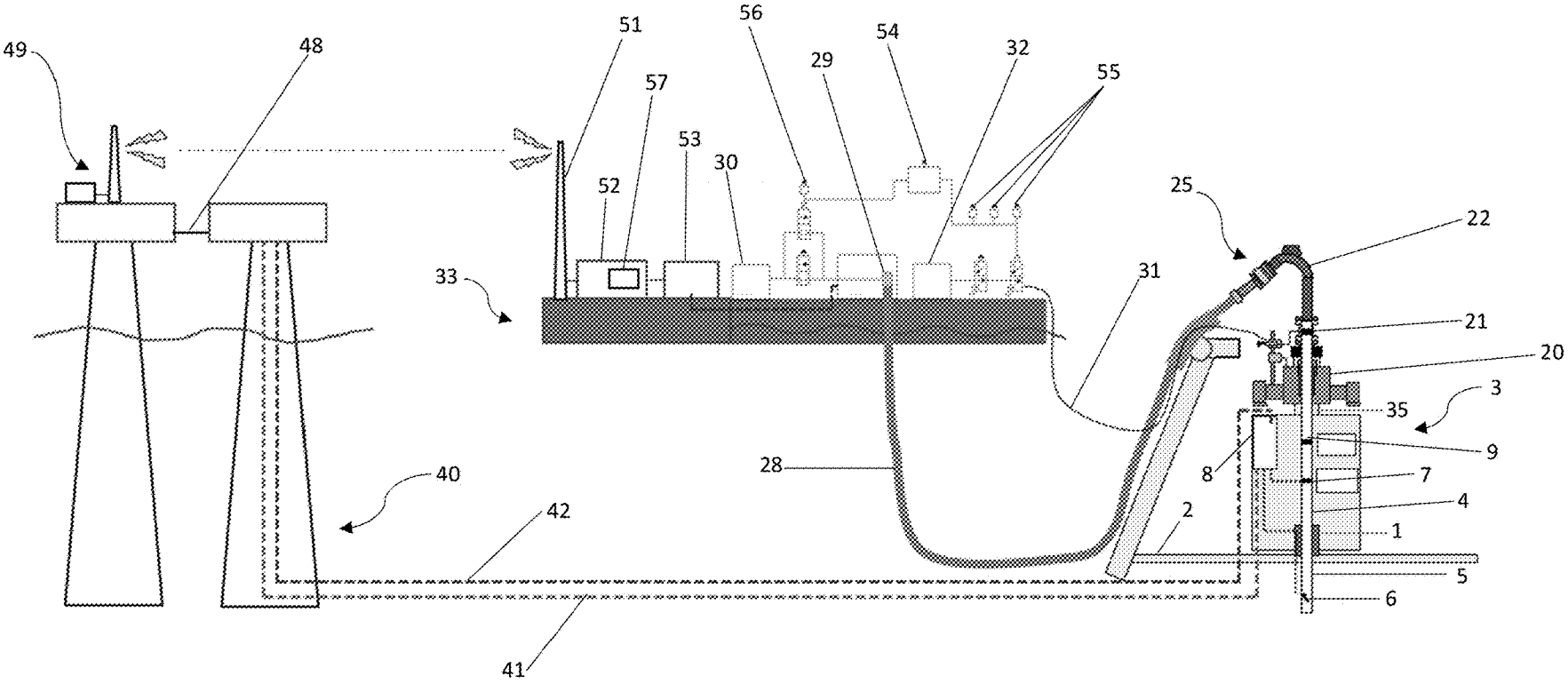
20
22
21
3
9
4
5
35
7
1
6
25
8
2
31
55
32
54
29
56
28
30
53
57
51
52
42
41
33
40
48
49

WELL STIMULATION OPERATIONS

CROSS-REFERENCE TO RELATED APPLICATIONS

This application is a provisional application which claims benefit under 35 USC § 119(e) to U.S. Provisional Application Ser. No. 62/939,271 filed Nov. 22, 2019, entitled "DELIVERING FLUID TO A SUBSEA WELLHEAD" and to U.S. Provisional Application Ser. No. 62/988,212 filed Mar. 11, 2020, entitled "WELL STIMULATION OPERATIONS", both of which applications are incorporated herein in their entirety.

STATEMENT REGARDING FEDERALLY SPONSORED RESEARCH

None.

FIELD OF THE INVENTION

This invention relates to the delivery of pressurized fluid, for example acid for well stimulation, from a vessel to a hydrocarbon well via a wellhead installed on the seabed.

BACKGROUND OF THE INVENTION

In the process of extracting hydrocarbons (oil and/or gas) from a reservoir, it is often necessary to inject fluid, for example a stimulation fluid such as acid, into a hydrocarbon well.

For hydrocarbon production from chalk-type reservoirs, it is often necessary to improve the flowing capabilities in the reservoir by injecting acidic fluid into the reservoir rock. This is done by injecting fluid at high rate to create fractures and dissolve the near-bore formation in the reservoir.

It is also necessary to conduct scale squeeze operations on subsea hydrocarbon wells. This involves high pressure, high volume injection of a scale inhibitor chemical.

For hydrocarbon reservoirs under the seafloor, these types of operation are conventionally performed with a vessel with high rate/pressure pumping capabilities. For topside (dry tree) wells, where the Xmas tree is located on an offshore producing platform, this is done by connecting up to the well via the offshore platform. For subsea wells, where the Xmas tree is located on the seafloor (and the associated producing platform may be many kilometers away), high rate fluid pumping is normally performed via a workover riser from a jack-up rig or semi-submersible rig.

A specialized vessel is brought to the jack up rig and a hose from the vessel inserted into a suitable connector on the rig to supply fluid from the vessel to the subsea well via the workover riser between the jack up and the subsea Xmas tree. In a scale squeeze operation, the connection would be with the manifold rather than directly with the Xmas tree.

A workover riser is a riser that provides a conduit from the upper connection on the subsea tree to the surface, and which allows the passage of wireline tools and fluids into the wellbore. A workover riser can be run in open water without a drilling marine riser and therefore needs to be able to withstand the applied environmental forces, i.e. wind, waves and currents, or it can be used in combination with drilling marine riser or a high pressure riser system.

A workover riser is typically used during the installation of the upper completion tubing hanger where wireline operations will be required during installation and testing of the upper completion and during wellbore re-entries which require full bore wireline tool access; it can also be used for the retrieval of the tubing hanger and production tubing. A workover riser typically consists of the following: the tubing hanger running tool; intermediate riser joints; lubricator valve(s) to isolate the riser during loading/unloading of long wireline tool strings; a surface tree for pressure control of the wellbore and to provide a connection point for a surface wireline lubricator system; and a means of tensioning the riser, so that it does not buckle under its own weight; a wireline or coiled-tubing BOP, capable of gripping, cutting and sealing coiled tubing or wireline.

For use on semi-submersible rigs it may also include a Subsea Test Tree and an emergency-disconnect package capable of high-angle release; retainer valve to retain the fluid contents of the riser during an emergency disconnect; a stress joint to absorb the higher riser bending stresses at the point of fixation to the Subsea Test Tree.

A workover riser is thus a complicated and heavy-duty piece of equipment which is designed to be used for a wide variety of operations, including the relatively simple process of injection of fluids into the production bore of a well. In addition, the daily cost of a jack up rig is very high. It would be preferable to be able to avoid the use of both a jack up rig and a workover riser.

The inventors are aware of a system, described in European patent 2715046B1, for connecting a hose directly to a subsea Xmas tree. The system involves the subsea control module of a Xmas tree being taken over from the vessel, which means that the vessel has to have an independent workover control system (WOCS) installed. In addition, the necessary personnel to run the WOCS must be present on the vessel. The WOCS is typically 6 meters or more in length containing a complex array of equipment such as hydraulic actuators, valves, lines and associated electronic control. The system described in EP2715046B1 may be suitable for performing a scale squeeze operation but is not suitable for any operation which involves dropping large diameter balls down the well. Therefore, completion designs (e.g. acid stimulation designs) are not possible if they require the pumping of large OD balls through the complete system and into the production bore, to activate the permanent installed completion assemblies.

The inventors are not aware of any existing equipment which caters for the pumping of large OD balls through the system. The inventors are also not aware of direct delivery of acid to a subsea wellhead/Xmas tree from a stimulation vessel having been done before.

BRIEF SUMMARY OF THE DISCLOSURE

The inventors have appreciated that it is possible to conduct operations on a subsea well involving the injection of high volumes of fluid at high pressure, including stimulation operations involving the dropping of balls, direct from a pumping vessel to the subsea well, without relying on a jack up rig and without taking control of the subsea control module of the Xmas tree with a workover control system.

In order to do this, certain functions of the fluid injection operation and/or the subsea fluid injection system should be controlled from the vessel but not all functions need be controlled from the vessel and, in particular, the vessel need not take over control of the subsea control module of the Xmas tree (as proposed in 2715046B1), which involves complex equipment and processes on the vessel (WOCS) which duplicate those already in place on the host platform and between the host platform and Xmas tree.

In order to have sufficient control of the fluid injection process (e.g. to be able to shut down the operation if there is any problem), the vessel needs to be provided with certain downhole and Xmas tree information from the well. This can include pressures and flow rates and the status of certain valves, for example.

In one conventional way of performing this type of operation, data can be provided to a pumping vessel from the host platform via a temporary data cable between the vessel and the host platform. However, if a subsea well is a long distance from the platform then this is impractical. In one project which the inventors are working on, the subsea wellhead is some 14 km from the host platform. For this situation, the inventors have appreciated that certain of the downhole data may be provided via a radio data link from the platform to the vessel since a 14 km temporary copper cable is impractical.

The invention more particularly includes a method for delivering a fluid treatment from a pumping vessel to a subsea well, where the method comprises delivering fluid to the well through a delivery system comprising a delivery line running between the vessel and a subsea wellhead and Christmas tree assembly; directly controlling at least one function of the system from the vessel, via a control line between the vessel and the assembly; and controlling a subsea control module of the assembly directly from a host platform, including receipt at the host platform of downhole data from the well.

The functions of the system controlled from the vessel include emergency shut-off of the flow of fluid from the vessel, detachment of the delivery line from the vessel, or control of rate of delivery and/or pressure of fluid from the vessel, amongst other things.

Data may be transmitted from the host platform to the vessel and displayed for the crew of the vessel to assist in management of the process from the vessel. This may be in addition to data from the platform being fed directly to the computerized pump control system, so that certain functions, e.g. emergency shut down of pumps, may be carried out automatically.

The data transmitted for display and/or to the computerized pump control system may include one or more of: (a) pressure data from sensors located upstream of the production wing valve (PWV), upstream of the annulus master valve (AMV), in production bore, or in the annulus, (b) temperature data from sensors located upstream of the production wing valve (PWV), upstream of the annulus master valve (AMV), in production bore, or in the annulus, (c) data on the status of one or more of: the production master valve and downhole safety valve, (d) data relating to Production Shutdown or Emergency Shutdown (ESD) status on the host platform, (e) the communication status between host platform and subsea control module, (f) a watch dog alarm on the wireless link.

The system may comprise a fail-safe close valve controlled from the vessel, as described in co-pending application No. 62/939,271, the contents of which are incorporated herein by reference. At least a production master valve may be controlled by the subsea control module from the host platform.

The downhole data may include one or more of production bore pressure, production bore temperature, an annulus pressure, an annulus temperature, the status of a production master valve or the status of a downhole safety valve.

Although the singular term "host platform" is used, the host platform may in fact comprise several platforms which have data communication with each other and sited near each other, e.g. within 500 m of each other.

The method was developed to serve a situation where the subsea wellhead and pumping vessel are a considerable distance from the host platform, e.g. from 1 to 50 km, 5 to 30 km or 10 to 20 km.

The method is especially suited to acid stimulation treatment using a so-called stimulation vessel, and has been developed with this in mind. Reference is made again here to the contents of co-pending application No. 62/939,271. However, the invention described in the present application may be broader and apply to other pressurized fluid treatments such as scale squeeze. Scale squeeze is normally delivered to a manifold, rather than directly to the Xmas tree.

A fail-safe close valve is a valve which is biased by some means to the closed position and requires active control, e.g. hydraulic pressure or an electric signal, to open it. A hose is a flexible conduit suitable for delivering fluid.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

BRIEF DESCRIPTION OF THE DRAWINGS

A more complete understanding of the present invention and benefits thereof may be acquired by referring to the following description taken in conjunction with the accompanying drawings in which:

FIG. 1 is a schematic representation of a subsea template and Xmas tree connected to a stimulation vessel (not to scale), in accordance with the invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Referring to FIG. 1, a first embodiment of the invention will be described. A subsea wellhead 1, part of a subsea template 2 and Xmas tree 3 is shown. The template 2 serves more than one well (normally four), and a corresponding number of Xmas trees are mounted on the template one being shown at reference 3. A manifold (not shown, but conventional in this art), connects all four Xmas trees and provides a common point of entry to all wells. The Xmas tree 3 is an assembly of conduits and valves, as is well known in the oil and gas field.

Referring to FIG. 1, an internal conduit 4 of the Xmas tree is connected via a seal sub assembly to the production tubing 5 of the well. In the production tubing is a downhole safety valve 6 and further up in the Xmas tree conduit is a production master valve 7. Both of these valves are operable via a subsea control module 8 which is in turn connected via a service umbilical and jumpers cables to the control room of a production platform or family of platforms 40 from which the well is operated; this platform could be many kilometers away. The service umbilical and jumpers include electrical and/or optical fiber communications 42 and hydraulic supply 41.

Above the production master valve 7 is the production swab valve 9, which is manually operated. In this subsea setting, the valve would normally be opened or closed by a work class subsea remote operated vehicle (WROV). At the top of the Xmas tree there would normally be a Tree cap, which provides protection to the Xmas tree re-entry hub and provides an additional mechanical well barrier; this is not shown in FIG. 1 but is entirely conventional.

All of the above description is conventional. Xmas trees may incorporate further valves, for example a second production master valve, but this is not relevant to the invention.

The connection to the production platform for the production of hydrocarbons from the well is not shown but is conventional: hydrocarbons that come up the production tubing are routed through the production bore of the Xmas tree and the flow control module, then leave the Xmas tree via a manifold hub pipework and are then routed into the manifold pipelines which feed into the production line to the platform.

FIG. 1 shows a pressurized fluid injection assembly 20 at the top of the Xmas tree. At the top of the Xmas tree is a re-entry hub 35 onto which an "H4 connector" (conventional in this art) locks; there is also an internal stinger (also conventional in this art).

The assembly 20 is lowered onto the Xmas tree 3 by crane and guided into position by a WROV, using the standard connections. The assembly 20 comprises a fail-safe close valve 21 and a gooseneck 22 to support the connector assembly 25.

The hose is standard, flexible, high pressure hose, able to withstand pressures of up to 10,000 psi and to withstand acid and other chemicals which may be delivered down the hose.

The hose 28 is lowered into position using a crane (not shown) to make connection via the connection assembly 25. Prior to making the connection, the production master valve (PMV) and downhole safety valve(s) (DHSV) are shut by signals from the host production platform central control room (CCR). The production swab valve (PSV) is shut by direct manipulation by a WROV or potentially by divers using an ROV torque tool.

The connection between the hose 28 and fluid injection assembly 20 is then made by WROV, and the PMV, DHSV(s) and PSV opened. At this point, the communication between production tubing and the hose is controlled solely via the fail-safe close (FSC) valve 21 on the fluid injection assembly 20 installed on the Xmas tree. The FSC valve 21 has a hydraulic control line 31 running up to a control unit 32 on the vessel 33. This valve is thereby controlled exclusively from the vessel. The fail-safe valve is of a standard gate valve design, incorporating a spring actuator to provide the means for the valve to move_to the closed position if the hydraulic supply pressure is removed, as is well known in the oil and gas field.

The other end of the hose 28 is connected via a quick release connection 29 of known type to fluid supply apparatus 30 on board the vessel 33.

When fluid, such as acid, is to be delivered to the well, the FSC valve 21 is opened from the vessel via a hydraulic control line 31, the PMV, PSV and DHSV(s) having all been opened previously by direct command from the host platform, via the subsea control module 8 or, in the case of the PSV, by direct manipulation.

The connection between the hose 28 and the fluid supply reel on the vessel is a quick release connector 29 and is designed such that if the vessel cannot remain in the correct position, e.g. due to weather conditions or a Drive off/Drift off scenario, an accumulator supplied, high pressure hydraulic fluid will be directed to the quick release connector and the hose quickly released and dropped from the hose reel. In this event the FSC valve 21 on the fluid injection assembly 20 on the Xmas tree will also be closed by operatives on the vessel via the control line 31 as part of a programmed Emergency Quick Disconnect (EQD) logic sequence.

The vessel is provided with a single EQD control 54 on the bridge of the vessel which simultaneously actuates the quick release connector 29 and shuts off the FSC valve via hydraulic control line 31. Further controls 56 and 56 are provided to allow for shut off the FSC valve and actuation of the connector 29 independently.

In normal operations, the vessel will shut down the pumps manually.

Certain data sent from the platform to the vessel via the radio data link can be used to provide an automatic means to shut down the pumps which will reduce the risk of over pressurizing the annulus bore in the Well and on the pumping vessel if Xmas tree valves are closed during pumping operations.

The operatives on the vessel 33 may rely on data communicated from the host platform 40 in order to make decisions about shutting down the pumps and closing pump room valves and whether the FSC valve should be closed.

The vessel 33 also has the facility to vary the rate of flow of acid and/or pressure of delivery of acid into the well, which can be done by operatives on the vessel in response to information from downhole sensors. Alternatively, the acid flow rate and/or pressure may be controlled from the vessel automatically in response to downhole data. The relevant downhole data may include production tube pressure, annulus pressure, production tube flow or annulus flow information.

It is also helpful for the operatives on the vessel to know about the status of the valves in the Xmas tree and production tubing which are controlled by the host platform via the subsea control module 8. Rather than taking a call from the host platform, data on the status of these valves may be communicated directly to the vessel along with the information from the downhole sensors.

The vessel is equipped with a radio mast 51, radio receiver and associated signal processing unit 52, and graphic user interface 57. The radio receiver/signal processor is also connected to a computerized pump control system 53. This is where data received via the data link from the platform can be configured to automatically shut down the pumps if certain pressure values in the Well or Xmas tree are reached etc.

The host platform is equipped with a radio transmitter and mast indicated generally at 49 via which various data which is available at the host platform may be transmitted to the vessel. The host platform, indicated generally at 40, may in fact consist of two or more platforms connected by a signal cable or wireless data link 48.

Types of data transmitted include pressure and temperature data from sensors located upstream of the production wing valve (PWV), upstream of the annulus master valve (AMV), in production bore, in the annulus. Also transmitted are data on the status of the following Xmas tree valves: PWV, production master valve (PMV), downhole safety valve (DHSV), as well as data relating to Production Shutdown (PSD) and Emergency Shutdown (ESD) status on the host platform, the communication status between host platform and subsea control module and a watch dog alarm on the wireless link.

Some or all of this information may be displayed on the user interface 57 to inform decisions by the vessel crew, and information also fed directly to the computerized control system 53 for automatic control of certain functions.

In the prior art arrangement, with a vessel connected by temporary copper wire to the platform, the data is fed only to a computerized control system. In the system according to the invention, the vessel crew is kept informed of critical information via the GUI 57. This is especially desirable if the vessel is a long way, e.g. many kilometers, from the platform.

In a modified embodiment, which is suitable for scale squeeze operations, the hose from the vessel is connected to the manifold (not shown in FIG. 1), rather than directly to the Xmas tree. The manifold is a conventional piece of equipment which connects together all the Xmas trees of the template and provides a common point of entry (and exit). The manifold, conventionally, includes controllable valving which allows fluid to be delivered to a selected Xmas tree.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience: EP2715046B1 Subsea Systems.

The invention claimed is:

1. A method for delivering a fluid treatment from a pumping vessel to a subsea well, the method comprising:

a. delivering fluid to the well through a delivery system comprising a delivery line running between the vessel and a subsea wellhead and Xmas tree assembly;

b. directly controlling at least one function of the system from the vessel, via a control line between the vessel and the assembly;

c. controlling a subsea control module of the assembly directly from a host platform, including receipt at the host platform of downhole data from the well;

wherein, after receipt of the downhole data at the host platform, the downhole data is transmitted via a radio data link from the host platform to the vessel and displayed on the vessel.

2. The method according to claim 1, wherein the functions of the system controlled from the vessel include one or more of:

a. Emergency shut-off of the flow of fluid from the vessel;

b. Detachment of the delivery line from the vessel;

c. Control of rate of delivery and/or pressure of fluid from the vessel.

3. The method according to claim 1, wherein the transmitted downhole data includes one or more of:

a. pressure data from sensors located upstream of a production wing valve (PWV), upstream of an annulus master valve (AMV), in a production bore, or in an annulus;

b. temperature data from sensors located upstream of the production wing valve (PWV), upstream of the annulus master valve (AMV), in the production bore, or in the annulus;

c. data on the status of one or more of: a production master valve and a downhole safety valve;

d. data relating to Production Shutdown or Emergency Shutdown (ESD) status on the host platform;

e. the communication status between the host platform and the subsea control module; and f. watch dog alarm on the radio data link.

4. The method according to claim 1, wherein the system comprises a fail-safe close valve controlled from the vessel.

5. The method according to claim 1, wherein at least a production master valve is controlled by the subsea control module from the host platform.

6. The method according to claim 1, wherein the downhole data includes one or more of:

(a) Production bore pressure;

(b) Production bore temperature;

(c) An annulus pressure;

(d) An annulus temperature;

(e) Status of a production master valve;

(f) Status of a downhole safety valve.

7. The method according to claim 1, wherein the host platform is a plurality of platforms having the facility to communicate data between them.

8. The method according to claim 1, wherein the subsea wellhead is located at a distance selected from more than 1 km, more than 5 km, more than 10 km, between 1 and 50 km, between 5 and 30 km, between 10 and 20 km, and greater than 50 km from the platform.

9. The method according to claim 1, wherein the fluid treatment is acid stimulation and the vessel is a stimulation vessel.

10. The method according to claim 1, wherein the fluid treatment is a scale squeeze treatment and wherein the fluid is delivered to the wellhead and Xmas tree assembly via a manifold.

* * * * *